US012780493B2

(12) United States Patent
Zanon et al.

(10) Patent No.: US 12,780,493 B2
(45) Date of Patent: Nov. 3, 2026

(54) LID ASSEMBLY FOR A PACKAGE, LID-SPOUT GROUP FOR A PACKAGE AND PACKAGE HAVING A LID-SPOUT GROUP

(71) Applicant: TETRA LAVAL HOLDINGS & FINANCE S.A., Pully (CH)

(72) Inventors: Paolo Zanon, Modena (IT); Anna Rosa Vietri, Modena (IT); Rocco De Paola, Modena (IT); Pietro Martini, Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 104 days.

(21) Appl. No.: 18/839,279

(22) PCT Filed: Feb. 27, 2023

(86) PCT No.: PCT/EP2023/054846
§ 371 (c)(1),
(2) Date: Aug. 16, 2024

(87) PCT Pub. No.: WO2023/165931
PCT Pub. Date: Sep. 7, 2023

(65) Prior Publication Data

US 2025/0153892 A1 May 15, 2025

(30) Foreign Application Priority Data

Mar. 2, 2022 (EP) ..... 22159625

(51) Int. Cl.
*B65D 5/74* (2006.01)
*B65D 47/08* (2006.01)
*B65D 47/10* (2006.01)

(52) U.S. Cl.
CPC ..... *B65D 5/746* (2013.01); *B65D 47/0876* (2013.01); *B65D 47/106* (2013.01)

(58) Field of Classification Search
CPC .. B65D 5/746; B65D 47/0876; B65D 47/106; B65D 2251/0015; B65D 2251/0093; B65D 2401/15; B65D 51/228
See application file for complete search history.

(56) References Cited

U.S. PATENT DOCUMENTS

2016/0016703 A1* 1/2016 Mühlemann ..... B65D 41/06 222/566
2020/0017260 A1* 1/2020 Migas ..... B65D 43/162
(Continued)

FOREIGN PATENT DOCUMENTS

DE 102021117931 A1 1/2022
EP 3892561 A1 * 10/2021 ..... B65D 5/746
(Continued)

OTHER PUBLICATIONS

European Search Report issued in corresponding Application No. EP 22 15 9625 dated Jul. 25, 2022, 7 pages.
(Continued)

*Primary Examiner* — Bob Zadeh
(74) *Attorney, Agent, or Firm* — BUCHANAN INGERSOLL & ROONEY PC

(57) ABSTRACT

There is described a lid assembly comprising a coupling ring, a lid and a hinge element hinging the lid to the coupling ring and being in contact with a contact portion of the lid. The lid comprises a cover wall configured to cover the pouring outlet and a side wall protruding from the cover wall. The side wall comprises an end portion connected to the cover wall and a rim portion opposite to the end portion. The rim portion comprises a rim surface facing the coupling ring. The rim surface comprises a first portion, a second portion connected to the first portion and a third portion connected to the second portion and being closer to the
(Continued)

contact portion than the first portion. The second portion is transversal to the first portion and the third portion.

9 Claims, 3 Drawing Sheets

(56) References Cited

U.S. PATENT DOCUMENTS

| | | | | |
|---|---|---|---|---|
| 2023/0271755 | A1* | 8/2023 | Gonnert | B65D 55/16 215/250 |
| 2023/0356888 | A1* | 11/2023 | Zanon | B65D 5/749 |
| 2025/0153892 | A1* | 5/2025 | Zanon | B65D 51/228 |

FOREIGN PATENT DOCUMENTS

| | | | |
|---|---|---|---|
| EP | 3892562 | A1 | 10/2021 |
| EP | 3984898 | A1 | 4/2022 |
| WO | 2020160984 | A1 | 8/2020 |

OTHER PUBLICATIONS

International Search Report (PCT/ISA/210) and Written Opinion (PCT/ISA/237) mailed on May 19, 2023, by the European Patent Office as the International Searching Authority for International Application No. PCT/EP2023/054846, 10 pages.

* cited by examiner

LID ASSEMBLY FOR A PACKAGE, LID-SPOUT GROUP FOR A PACKAGE AND PACKAGE HAVING A LID-SPOUT GROUP

TECHNICAL FIELD

The present invention relates to a lid assembly for a package, in particular a package having a main body formed from a multilayer packaging material, filled with a pourable product, even more particular filled with a pourable food product.

Advantageously, the present invention also relates to a lid-spout group for a package, in particular a package having a main body formed from a multilayer packaging material, filled with a pourable product, even more particular filled with a pourable food product, and comprising a spout and a lid assembly.

Advantageously, the present invention also relates to a package, in particular a package having a main body formed from a multilayer packaging material, filled with a pourable product, even more particular filled with a pourable food product, and comprising a lid assembly, in particular a lid-spout group.

BACKGROUND ART

As is known, many liquid or pourable food products, such as fruit juice, UHT (ultra-high-temperature treated) milk, wine, tomato sauce, etc., are sold in packages, in particular sealed packages, made of sterilized packaging material.

A typical example is the parallelepiped-shaped package for pourable food products known as Tetra Brik Aseptic (registered trademark), which is made by sealing and folding a laminated strip packaging material. The packaging material has a multilayer structure comprising a carton and/or paper base layer, covered on both sides with layers of heat-seal plastic material, e.g. polyethylene. In the case of aseptic packages for long-storage products, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Some of the known packages comprise a main body formed from the multilayer packaging material and a lid-spout group arranged on the main body. The lid-spout group comprises a spout having a pouring outlet and a lid assembly coupled to the spout and configured to selectively close and open the pouring outlet.

The lid assembly comprises a coupling ring arranged around a portion of the spout, a lid configured to selectively move between a closing position and an opening position in which the lid is configured to respectively close and open the pouring outlet and a hinge element hinging the lid to the coupling ring. The lid can be repeatably moved between the closing position and the opening position.

Even though the known lid assemblies work satisfyingly well, a desire is felt in the sector to provide a further improved lid assembly.

In particular, there is a desire felt in the sector to provide a correct positioning of the lid assembly in the closing position and to avoid any possible jamming of the lid assembly.

DISCLOSURE OF INVENTION

It is therefore an object of the present invention to provide in a straightforward and low-cost manner an improved lid assembly for a package, in particular a package having a main body formed from a multilayer packaging material, filled with a pourable product, even more particular filled with a pourable food product.

In particular, it is an object of the present invention to provide in a straightforward and low-cost manner an improved lid assembly for a package, in particular a package having a main body formed from a multilayer packaging material, filled with a pourable product, even more particular filled with a pourable food product, which comes along with an improved placing of the lid in the closing position, and which allows avoiding any jamming.

It is a further object of the present invention to provide in a straightforward and low-cost manner an improved lid-spout group for a package, in particular a package having a main body formed from a multilayer packaging material, filled with a pourable product, even more particular filled with a pourable food product.

It is a further object of the present invention to provide in a straightforward and low-cost manner an improved lid-spout group for a package, in particular a package having a main body formed from a multilayer packaging material, filled with a pourable product, even more particular filled with a pourable food product, which comes along with an improved placing of the lid in the closing position, and which allows avoiding any jamming.

It is a further object of the present invention to provide in a straightforward and low-cost manner a package, in particular a package having a main body formed from a multilayer packaging material, filled with a pourable product, in particular filled with a pourable food product, comprising an improved lid assembly, in particular a lid assembly which comes along with an improved placing of the lid in the closing position, and which allows avoiding any jamming.

According to the present invention, there is provided a lid assembly according to claim 1.

Further advantageous embodiments of the lid assembly are specified in the claims being directly or indirectly depending on claim 1.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Figure 1:
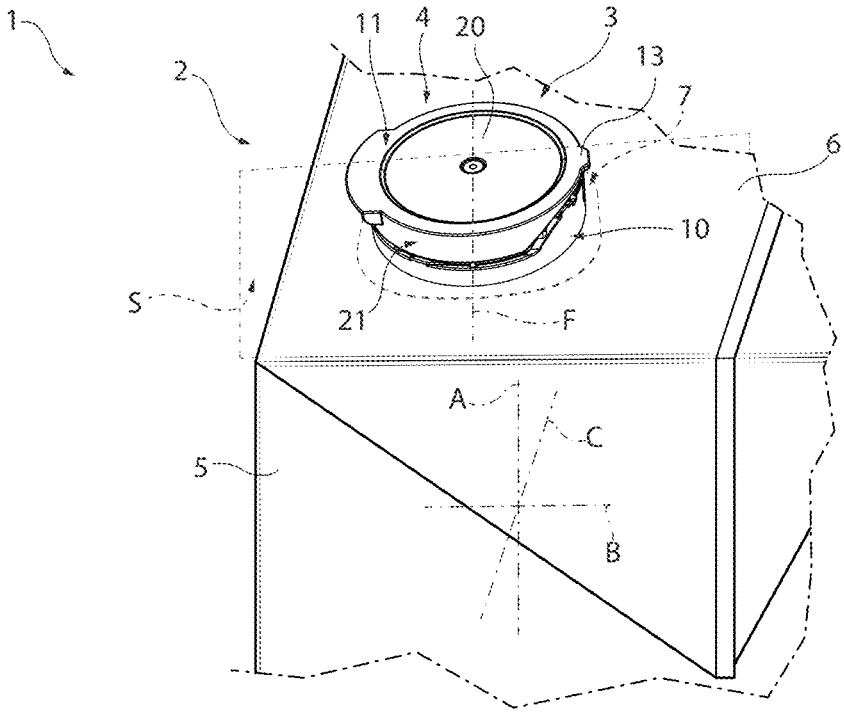
FIG. 1 is a schematic perspective view of a portion of a package having a lid assembly according to the present invention, with parts removed for clarity.

Number 1 indicates as a whole a package (only partially shown to the extent necessary for the comprehension of the present invention) comprising:

- a main body 2, in particular formed from a multilayer packaging material, being filled with a pourable product, in particular a pourable food product; and a lid-spout group 3 arranged on main body 2 and having at least a spout 8 (see FIG. 5) arranged on main body 2 and a lid assembly 4 coupled to spout 8.

The multilayer packaging material may comprise a layer of fibrous material, such as e.g. paper or cardboard, and at least two layers of heat-seal plastic material, e.g. polyethylene, interposing the layer of fibrous material in between one another. One of these two layers of heat-seal plastic material defines the inner face of main body 2 contacting the pourable product.

Preferably, the multilayer packaging material may also comprise a layer of gas- and light-barrier material, e.g. aluminum foil or an ethylene vinyl alcohol (EVOH) film, in particular being arranged between one of the layers of the heat-seal plastic material and the layer of fibrous material.

Preferentially, the multilayer packaging material may also comprise a further layer of heat-seal plastic material being interposed between the layer of gas- and light-barrier material and the layer of fibrous material.

Preferentially, each main body 2 may be formed from a respective blank of the multilayer packaging material. Even more preferentially, the multilayer packaging material may be provided in the form of a web.

In particular, the web may be formed from a plurality of blanks, which are successively arranged so as to form the web. Even more particular, the web may comprise a plurality of successively arranged repeated patterns, each pattern defining a respective blank.

Preferentially, main body 2 may be obtained by forming a tube from the multilayer packaging material, longitudinally sealing the tube, filling the tube with the pourable product and transversally sealing and cutting the tube.

According to a preferred non-limiting embodiment, each spout 8 may be applied onto the respective main body 2 during or after forming, filling and sealing the respective main body 2.

Alternatively, each spout 8 could be applied onto the multilayer packaging material, e.g. prior to arranging the multilayer packaging material within or during advancement of the multilayer packaging material through a packaging machine for forming, filling and sealing main bodies 2 from the multilayer packaging material.

According to some possible non-limiting embodiments, each spout 8 and each lid assembly 4 may be formed from a polymer, in particular by means of a respective molding process.

Preferentially, each lid assembly 4 may be formed as a single piece, i.e. the various components of lid assembly 4 may be integrally connected to one another.

In particular, each spout 8 may be molded onto the multilayer packaging material or to main body 2.

Alternatively, each spout 8 could be adhesively bonded and/or welded and/or ultrasonically bonded onto the multilayer packaging material or to main body 2.

Preferentially, lid assembly 4 may be coupled to spout 8 prior or after application of spout 8 onto main body 2 or onto the web of packaging material.

According to some preferred non-limiting embodiments, spout 8 and lid assembly 4 are obtained, in particular molded, from a polymeric material.

With particular reference to FIG. 1, main body 2 may extend along a longitudinal axis A, a first transversal axis B and a second transversal axis C. In particular, the extension of main body 2 along longitudinal axis A may be larger than the extension of main body 2 along first transversal axis B and second transversal axis C.

Preferentially, main body 2 may be parallelepiped-shaped.

According to some preferred non-limiting embodiments, main body 2 comprises a first wall portion (not shown and known as such), in particular being transversal, even more particular perpendicular, to axis A, from which main body 2 extends along axis A. Preferably, the first wall portion defines a support wall of package 1, in particular main body 2, which is designed to be put in contact with a support surface, such as e.g. a shelf, when, in use, being e.g. exposed within a sales point or when being stored. In particular, when being arranged on the support surface the first wall portion defines a bottom wall portion.

Main body 2 may also comprise one or more lateral walls 5 being (fixedly) connected to the first wall portion and extending, in particular substantially parallel to axis A, from the first wall portion.

Main body 2 may also comprise a second wall portion 6 opposite to the first wall portion and being (fixedly) connected to at least some of lateral walls 5. In particular, lateral wall(s) 5 may be interposed between the first wall portion and second wall portion 6. In particular, when the first wall portion is arranged on a support surface second wall portion 6 may define a top wall portion.

According to some non-limiting embodiments, the first wall portion and second wall portion 6 may be parallel to one another.

According to a non-limiting alternative embodiment not shown, the first wall portion and second wall portion 6 could be inclined with respect to one another.

Second wall portion 6 may carry the respective lid-spout group 2, in particular the respective spout 8.

According to some preferred non-limiting embodiments, package 1, in particular main body 2, may comprise an inner space configured to contain and/or containing the pourable product. In particular, the first wall portion, lateral wall(s) 5 and second wall portion 6 delimit the inner space.

Figure 5:
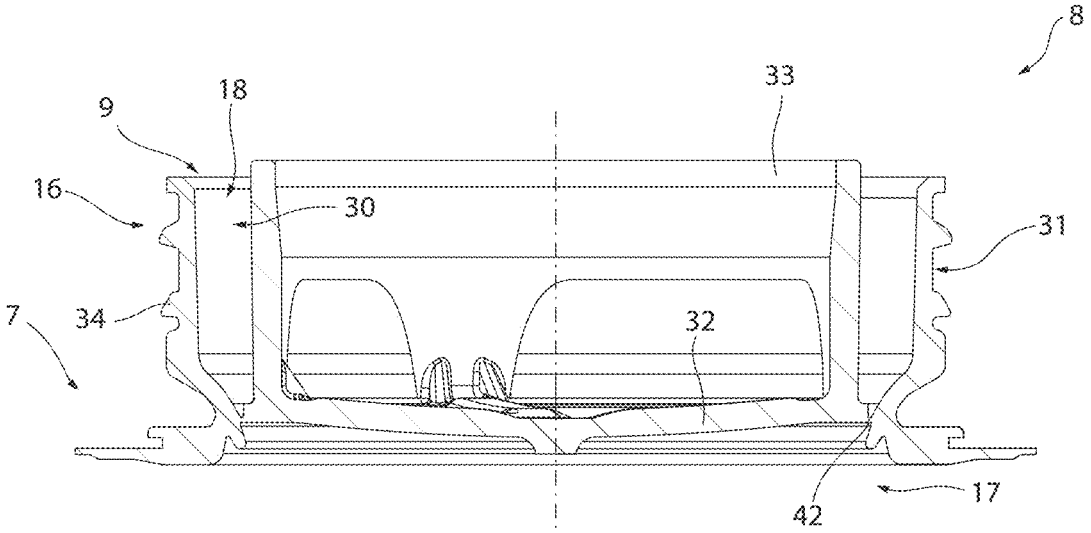
FIG. 5 is a section view of a detail of a lid-spout group of the package of FIG. 1, with parts removed for clarity.

In more detail and with particular reference to FIG. 5, spout 8 may comprise at least:

a pouring outlet 9 configured to allow for the outflow of the pourable product from package 1, in particular main body 2; and a collar 16 carrying and/or comprising pouring outlet 9.

Preferentially, spout 8 also comprises a base frame 7 coupling and/or configured to couple spout 8 to main body 2, in particular to second wall portion 6.

In more detail, collar 16 may extend along a longitudinal axis, in particular parallel to axis A, and may carry and/or comprise pouring outlet 9 at a first axial end of collar 16 itself and an inlet opening 17 for the pourable product at a second axial end of collar 16 itself opposite to the first axial end. Preferentially, collar 16 may be integrally connected to base frame 7.

In particular, collar 16 may delimit and/or comprises a flow channel 18 for the pourable product extending between inlet opening 17 and pouring outlet 9. In use, collar 16 receives the pourable product from the inner space through inlet opening 17 and allows outpouring of the pourable product from pouring outlet 9.

Preferentially, collar 16 may comprise an inner surface 30 delimiting flow channel 18. Even more preferentially, collar 16 may also comprise an outer surface 31 opposite to inner surface 30.

With particular reference to FIGS. 1 to 4, lid assembly 4 comprises at least:

a coupling ring 10 arrangeable and/or arranged around a portion of spout 8, in particular collar 16;

a lid 11 configured to selectively close and open pouring outlet 9 of spout 8; and a hinge element 12 hinging lid 11 to coupling ring 10.

Hinge element 12 may be configured to allow for movement of lid 11 between a closing position (shown in FIGS. 1 to 3) in which lid 11 is configured to close and/or cover pouring outlet 9, in particular for impeding an outflow of the pourable product through pouring outlet 9, and an opening position (not shown) in which lid 11 is configured to free pouring outlet 9, in particular for allowing an outflow of the pourable product through pouring outlet 9.

In particular, hinge element 12 may define a hinge axis E, in particular transversal, even more particular perpendicular, to the longitudinal axis of collar 16, and lid 11 may be angularly moveable around hinge axis E for moving lid 11 between the closing position and the opening position.

Figure 2:
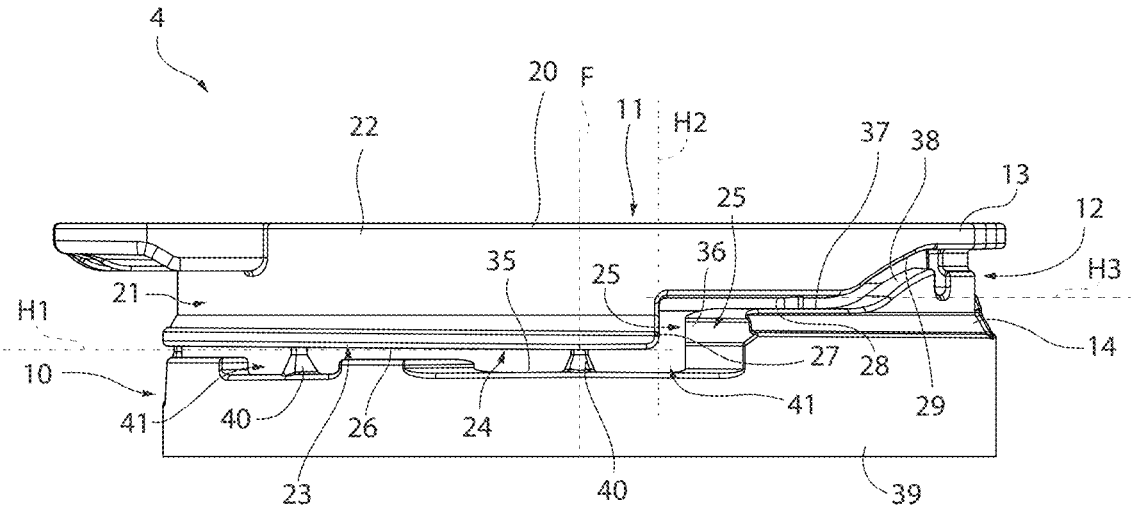
FIG. 2 is a side view of the lid assembly of FIG. 1, with parts removed for clarity.
Figure 3:
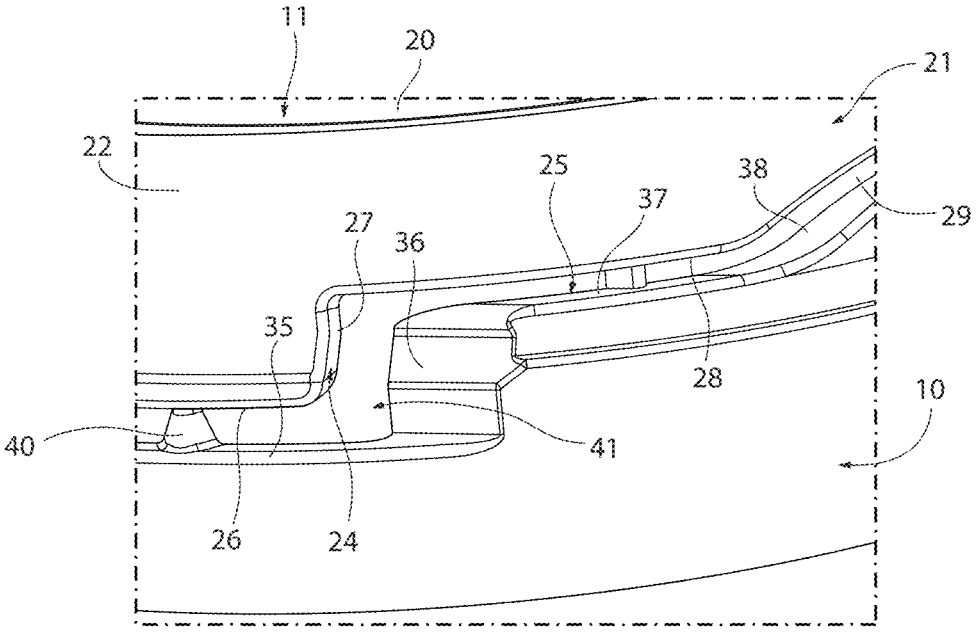
FIG. 3 is an enlarged view of a portion of the lid assembly of FIG. 1, with parts removed for clarity.
Figure 4:
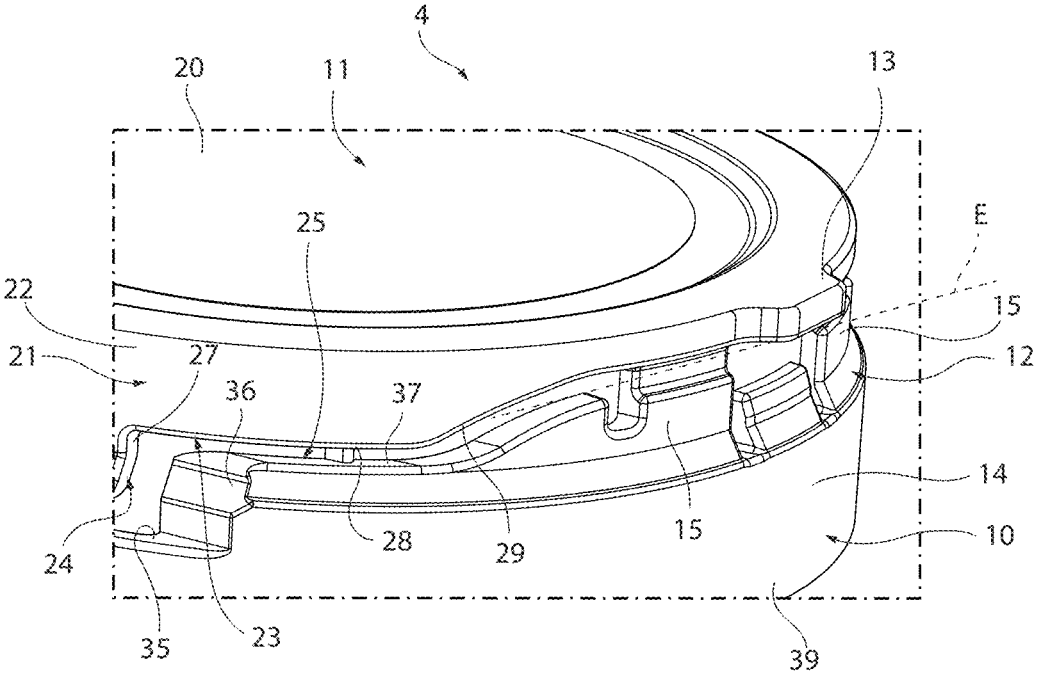
FIG. 4 is an enlarged view of a detail of the lid assembly of FIG. 1, with parts removed for clarity.

With particular reference to FIGS. 1, 2 and 4, hinge element 12 contacts lid 11 at a contact portion 13, and in particular may contact coupling ring 10 at a contact section 14 of coupling ring 10.

Preferentially, hinge element 12 may be integrally connected to lid 11 and coupling ring 10.

With particular reference to FIGS. 2 and 4, hinge element 12 may comprise one or more coupling elements 15, in the specific non-limiting embodiment shown two coupling elements 15, fixed to coupling ring 10 at coupling section 14 and fixed to lid 11 at coupling portion 13.

Preferentially, lid assembly 11 may comprise a central axis F, in particular being perpendicular to hinge axis E and/or parallel to the longitudinal axis of collar 16.

With particular reference to FIGS. 1 to 4, lid 11 comprises a cover wall 20 configured to cover pouring outlet 9, in particular with lid 11 being in the closing position, and a side wall 21 protruding from cover wall 20. In particular, with lid 11 being in the closing position, side wall 21 surrounds a portion of collar 16.

In more detail, side wall 21 comprises an end portion 22 connected to, in particular integrally connected to, the cover wall 20 and a rim portion 23 opposite to end portion 22.

Additionally, rim portion 23 comprises a rim surface 24 facing coupling ring 10, in particular an end surface 25 of coupling ring 10.

In particular, a profile of rim surface 24 defines and/or corresponds to a profile of rim portion 23. Even more particular the profile of rim surface 24 is chosen so as to facilitate a positioning of lid 11 in the closing position and to avoid any jamming of lid 11.

More specifically, rim surface 24 and the respective profile, and in particular also end surface 25 and the respective profile, may be annular.

Preferentially, rim surface 24 and end surface 25 may be substantially parallel to one another. In other words, the profile of rim surface 24 and a profile of end surface 25 are substantially parallel to one another. In particular, this is obtained as the profile of rim surface 24 and the profile of end surface 25 are annular and rim surface 24 is distanced from, but follows the shape of, end surface 25.

In further detail, rim surface 24 and end surface 25 define an interspace arranged between rim surface 24 and end surface 25.

More specifically, rim surface 24 comprises a first portion 26, a second portion 27 connected to first portion 26 and a third portion 28 connected to second portion 27. Thereby, third portion 28 is closer to contact portion 13 than first portion 26.

In particular, second portion 27 is interposed between first portion 26 and third portion 28 and connects first portion 26 and third portion 28 to one another.

In other words, second portion 27 has a first end and a second end opposed to the first end. The first end is connected to first portion 26 and the second end is connected to third portion 28.

Moreover, second portion 27 is transversal, in particular perpendicular, to first portion 26 and third portion 28.

Preferentially, first portion 26 and third portion 28 may be parallel to one another.

Preferentially, rim surface 24 may comprise a fourth portion 29 connected to third portion 28 and extending to contact portion 13. In particular, fourth portion 29 is transversal to third portion 28.

In further detail, first portion 26 may lie in a first plane H1, second portion 27 may lie in a second plane H2 and third portion 28 may lie in a third plane H3.

Preferentially, second plane H2 may be transversal, in particular perpendicular, to first plane H1 and third plane H3.

Additionally, first plane H1 and third plane H3 may be spaced apart from one another and parallel to one another.

According to some preferred non-limiting embodiments, end surface 25 may comprise a first section 35, a second section 36 connected to first section 35 and a third section 37 connected to second section 36 and being closer to contact section 14 than first section 35. Moreover, end surface 25 may also comprise a fourth section 38 connected to third section 37 and extending to coupling section 14.

In particular, second section 36 may be transversal, in particular perpendicular, to first section 35 and third section 37.

Preferentially, first section 35, second section 36 and third section 37 may face and may be parallel to first portion 26, second portion 27 and third portion 28, respectively. Additionally, fourth section 38 may be parallel to and may face fourth portion 29.

According to some preferred non-limiting embodiments, lid 11 may be symmetric with respect to a symmetry plane S.

In particular, symmetry plane S may also divide rim surface 24 and end surface 25, each into a respective first half and a respective second half. Each first half and each second half being arranged at one respective side of side wall 21.

Even more specifically, hinge element 12 is substantially interposed between each first half and each second half.

Therefore, each one of first portion 26, second portion 27, third portion 28 and in particular also fourth portion 29, may comprise a respective first half and a second half.

More specifically, each first half of first portion 26 may be connected to the first half of second portion 27, which again may be connected to the first half of third portion 28, which in particular may be connected to the first half of the fourth portion 29.

In analogy, each second half of first portion 26 may be connected to the second half of second portion 27, which again may be connected to the second half of third portion 28, which in particular may be connected to the second half of the fourth portion 29.

In a similar manner, each one of first section 35, second section 36, third section 37 and in particular also fourth section 38, may comprise a respective first half and a second half.

More specifically, each first half of the first section 35 may be connected to the first half of second section 36, which again may be connected to the first half of third section 37, which in particular may be connected to the first half of the fourth section 38.

In analogy, each second half of first section 35 may be connected to the second half of second section 36, which again may be connected to the second half of third section 37, which in particular may be connected to the second half of the fourth section 38.

In further detail, the first half of first portion 26 may extend between a respective first angular position and a respective second angular position, in particular with respect to central axis F. Additionally, the first half of second portion 27 may extend between the respective second angular position and a respective third angular position (in particular with respect to center axis F). In the specific embodiment shown, the second angular position and the third angular position equal one another, i.e. the third angular position corresponds to the second angular position, in particular as second portion 27 extends parallel to central axis F. In other words, the second angular position and the third angular position are the same, i.e. second portion 27 extend parallel to central axis F. The first half of third portion 28 may extend between the respective third angular position and a respective fourth angular position (in particular with respect to center axis F). The first angular position differs from the second angular position and the fourth angular position differs from the third angular position. In other words, the first angular position and the fourth angular position are distinct from the second angular position and the third angular position, respectively.

In analogy, the second half of first portion 26 may extend between a respective first angular position and a respective second angular position, in particular with respect to central axis F. Additionally, the second half of second portion 27 may extend between the respective second angular position and a respective third angular position (in particular with respect to center axis F). In the specific embodiment shown, the second angular position and the third angular position equal one another, i.e. the third angular position corresponds to the second angular position, in particular as second portion 27 extends parallel to central axis F. In other words, the second angular position and the third angular position are the same, i.e. second portion 27 extend parallel to central axis F. The second half of third portion 28 may extend between the respective third angular position and a respective fourth angular position (in particular with respect to center axis F). The first angular position differs from the second angular position and the fourth angular position differs from the third angular position. In other words, the first angular position and the fourth angular position are distinct from the second angular position and the third angular position, respectively.

Furthermore, an angular position may extend from 0° at a position opposed to contact portion 13 to 180° at contact portion 13. In particular, symmetry plane S comprises the position at an angular position of 0° and a position at an angular position of 180°. Even more particular, while the 0° position and the 180° position lie on symmetry plane S all other positions between angular positions larger than 0° and smaller than 180° do not lie on symmetry plane S.

Preferentially, the second angular position corresponds to an angular position being smaller or equal to 120°, preferentially smaller or equal to 100°, even more particular smaller or equal to 90°. In this way, one can further reduce the risk of jamming as the connection area between first portion 26 and second portion 27, i.e. the point at which the first portion 26 joins the second portion 27, is well distanced from contact portion 13. Furthermore, this means that a possible undesired contact between the connection area and spout 8 would occur at an angle of lid 11 with respect to hinge axis E, which already reduces the risk of such an unwanted contact, i.e. at an angle at which the lid 11 has almost reached the closing position.

According to some preferred non-limiting embodiments, lid assembly 4 may comprise a retaining device so as to retain lid assembly 4 coupled to spout 8 once lid assembly 4 has been coupled to spout 8. In particular, the retaining device may be configured to limit an axial movement of coupling ring 10 along central axis F.

In more detail, spout 8 may comprise a retaining element 34, e.g. a continuous or discontinuous ring integral to and protruding from collar 16. The retaining device may comprise retaining element 34.

Coupling ring 10 may comprise a main ring 39 and a plurality of flap elements (not shown) protruding from an inner surface of main ring 39, in particular facing outer surface 31 of collar 16 and being configured to interact with the retaining element so as to limit an axial movement of coupling ring 10 when lid assembly 4 is coupled to spout 8.

In particular, each flap element may be connected to a respective portion of main ring 39. Preferentially, each flap element may define together with the respective portion of main ring 39 a V-shape.

Preferentially, the retaining device may comprise the flap elements.

According to some preferred non-limiting embodiments, lid assembly 4 may also comprise rupturable coupling bridges 40 connecting coupling ring 10 and lid 11 to one another. Coupling bridges 40 are designed to irreversibly rupture during the first control of lid 11 from the closing position to the opening position.

In particular, coupling bridges 40 may be rupturably connected to rim surface 24 or to end surface 25.

In further detail, each coupling bridge 40 may be arranged within a respective seat 41 of coupling ring 10, in particular main ring 39.

Advantageously, lid 11 may further comprise a sealing ring protruding away from, and in particular being connected to, cover wall 20 and configured to interact with collar 16 so as to seal pouring outlet 9 with lid 11 being in the closing position.

In particular, the sealing ring may be configured to at least partially protrude into flow channel 18 and to engage inner surface 30 of collar 16 with lid 11 being in the closing position.

According to some preferred non-limiting embodiments, lid assembly 4, may also comprise a closing membrane 32, preferentially operatively coupled to lid 11, in particular by means of a coupling structure 33 fixed to lid 11 and closing membrane 32, and configured to at least close and seal flow channel 18 prior to a first control of lid 11 from the closing position to the opening position. In particular, prior to the first movement of lid 11 from the closing position to the opening position, closing membrane 32 may be fused to inner surface 30 of collar 16, in particular rupturably fused to inner surface 30 along a weakening line 42.

Moreover, during a first movement of lid 11 from the closing position to the opening position, closing membrane 32 ruptures from inner surface 30 of collar 16. In particular, closing membrane 32 is broken along weakening line 42.

Afterwards, with lid 11 being newly arranged in the closing position, closing membrane 32 may be arranged within flow channel 18 for closing (but not sealing) flow channel 18.

In use, a user receives package 1 with lid 11 being in the closing position so as to seal pouring outlet 9 and to impede the pourable product to leave from pouring outlet 9.

In order to allow for the outpouring from pouring outlet 9, lid 11 needs to be controlled from the closing position to the opening position. The first time lid 11 is controlled from the closing position to the opening position coupling bridges 40, and in particular also closing membrane 32, irreversibly rupture.

Afterwards, it is again possible to control lid 11 from the opening position to the closing position.

The advantages of lid assembly 4 and/or lid-spout group 3 and/or of package 1 according to the present invention will be clear from the foregoing description.

In particular, the positioning of lid 11 in the closing position is facilitated by rim surface 24 having first portion 26, second portion 27 and third portion 28. Moreover, this also allows to avoid a possible jamming of lid 11 in that case that a user does not correctly operate lid 11.

Clearly, changes may be made to lid assembly 4 and/or lid-spout group 3 and/or package 1 as described herein without, however, departing from the scope of protection as defined in the accompanying claims.

The invention claimed is:

1. Lid assembly configured to be coupled to a spout of a package being filled with a pourable product;

the lid assembly comprises at least:

a coupling ring arrangeable around a portion of the spout;

a lid configured to selectively close and open a pouring outlet of the spout; and a hinge element hinging the lid to the coupling ring and being in contact with a contact portion of the lid;

wherein the lid comprises a cover wall configured to cover the pouring outlet and a side wall protruding from the cover wall;

wherein the side wall comprises an end portion connected to the cover wall and a rim portion opposite to the end portion;

wherein the rim portion comprises a rim surface facing the coupling ring;

wherein the rim surface comprises a first portion, a second portion connected to the first portion and a third portion connected to the second portion and being closer to the contact portion than the first portion;

wherein the second portion is perpendicular to the first portion and the third portion;

wherein the first portion lies within a first plane, the second portion lies within a second plane and the third portion lies within a third plane;

wherein the second plane is perpendicular to the first plane and the third plane;

wherein the first plane and the third plane are spaced apart from one another and parallel to one another;

wherein the rim surface comprises a fourth portion extending between the third portion and the contact portion; and wherein the fourth portion is transversal to the third portion.

2. Lid assembly according to claim 1, wherein the coupling ring comprises an end surface facing the rim surface;

wherein the end surface comprises a first section, a second section connected to the first section and a third section connected to the second section and being closer to a contact section of the coupling ring at which the hinge element is connected to the coupling ring than the first section;

wherein the second section is transversal to the first section and the third section.

3. Lid assembly according to claim 2, wherein the first section faces and is parallel to the first portion, the second section faces and is parallel to the second portion and the third section faces and is parallel to the third portion.

4. Lid assembly according to claim 1, wherein the first portion extends between a first angular position and a second angular position, the second portion extends between the second angular position and a third angular position, and the third portion extends between the third angular position and a fourth angular position.

5. Lid assembly according to claim 4, wherein the second angular position is smaller or equal to 120°.

6. Lid assembly according to claim 1, and further comprising a plurality of rupturable coupling bridges protruding from the coupling ring and connected to the rim surface.

7. Lid assembly according to claim 1, wherein the lid assembly is formed from a polymer.

8. Lid-spout group comprising at least the spout and the lid assembly according to claim 1 and coupled to the spout.

9. Package filled with the pourable product comprising the spout and the lid assembly according to claim 1 and being coupled to the spout.

* * * * *